US006684422B2

(12) United States Patent
LeFevre et al.

(10) Patent No.: US 6,684,422 B2
(45) Date of Patent: Feb. 3, 2004

(54) TOY RETENTION BLANKET AND SYSTEM

(75) Inventors: Abbie S. LeFevre, Sherman Oaks, CA (US); Lainie S. Quirk, Valley Village, CA (US)

(73) Assignee: Ginger Magnolia, Sherman Oaks, CA (US)

( * ) Notice: Subject to any disclaimer, the term of this patent is extended or adjusted under 35 U.S.C. 154(b) by 0 days.

(21) Appl. No.: 10/376,974

(22) Filed: Feb. 27, 2003

(65) Prior Publication Data

US 2003/0159193 A1 Aug. 28, 2003

Related U.S. Application Data

(60) Provisional application No. 60/360,246, filed on Feb. 27, 2002.

(51) Int. Cl.[7] ..... A63H 33/00; A47C 29/00; A47D 15/00

(52) U.S. Cl. ..... 5/496; 5/482; 5/655; 5/485; 2/69; 297/184.13; 446/227

(58) Field of Search ..... 446/73, 227; 5/482, 5/485, 486, 493, 655, 907, 494, 496; 297/184.13; 383/4; 2/69

(56) References Cited

U.S. PATENT DOCUMENTS

| | | | | | |
|---|---|---|---|---|---|
| 2,078,022 | A | * | 4/1937 | Roemer | 446/227 |
| 2,105,787 | A | * | 1/1938 | Herpich | 2/69 |
| D149,474 | S | * | 5/1948 | Claflin | D6/600 |
| 2,727,242 | A | * | 12/1955 | Pascal | 2/69 |
| 3,308,479 | A | | 3/1967 | Sesco | |
| 4,258,439 | A | * | 3/1981 | York | 2/69.5 |
| 4,655,502 | A | | 4/1987 | Houllis | |
| 4,824,168 | A | | 4/1989 | Makoski | |
| 4,833,731 | A | * | 5/1989 | Foxman | 2/48 |
| 4,968,279 | A | | 11/1990 | Smith | |
| 5,042,090 | A | * | 8/1991 | Cook | 2/69 |
| 5,131,096 | A | | 7/1992 | Olson | |
| 5,167,565 | A | * | 12/1992 | Metcalf | 446/491 |

(List continued on next page.)

OTHER PUBLICATIONS

Floppy Seat Web Site, http://www.floppyseat.com/about.htm, printed Feb. 27, 2003.

One Step Ahead Web Site, One Step Ahead Catalog, Toy And Bottle Keeper, http://www.onestepahead.com/jump.jsp?1Gen=detail&itemID=1068&itemType=Product & ProductID=1068, printed Feb. 27, 2003.

(List continued on next page.)

*Primary Examiner*—Michael F. Trettel
(74) *Attorney, Agent, or Firm*—Michael Blaine Brooks, P.C.; Michael B. Brooks; Andrew S. Naglestad

(57) ABSTRACT

The present invention discloses an interactive infant or child blanket with a tactile apparatus for removably attaching small toys such as pacifiers, teethers, rattles, and developmental toys. The invention also includes an apparatus for removably attaching the blanket itself to other objects such as a highchairs, baby bouncers, infant swings, car seats, strollers, or shopping carts, for play control and stability. The novel attachment system allows a child to play on the go without the hassle of dropping or soiling play objects, thereby minimizing the chance of loss or exposure to germs. The blanket preferably comes packaged in a matching bag that can also carry toy attachments and perhaps a bottle and/or diapers, providing parents with a small "baby to-go" bag for quick errands and trips. In another embodiment, the retention blanket includes a blanket adapted to engage a wheelchair as required by elderly and handicap persons.

27 Claims, 6 Drawing Sheets

U.S. PATENT DOCUMENTS

| | | | | | |
|---|---|---|---|---|---|
| 5,188,421 | A | | 2/1993 | Arseneault | |
| 5,193,238 | A | | 3/1993 | Clute | |
| 5,208,934 | A | * | 5/1993 | Bachnick et al. | 5/482 |
| 5,283,909 | A | * | 2/1994 | Hill | 2/69 |
| 5,640,932 | A | * | 6/1997 | Bianco et al. | 119/720 |
| 5,735,004 | A | * | 4/1998 | Wooten et al. | 5/502 |
| 5,781,946 | A | | 7/1998 | McEntire et al. | |
| D419,357 | S | * | 1/2000 | Atkinson | D6/603 |
| 6,133,454 | A | * | 10/2000 | Lecouve et al. | 548/515 |
| 6,176,356 | B1 | | 1/2001 | Powley | |
| 6,183,335 | B1 | | 2/2001 | Petersen | |
| 6,189,166 | B1 | | 2/2001 | Braine et al. | |
| 6,224,152 | B1 | | 5/2001 | Hughes et al. | |
| 6,327,726 | B1 | | 12/2001 | Weber et al. | |
| 6,427,265 | B1 | * | 8/2002 | Dix | 5/482 |

OTHER PUBLICATIONS

One Step Ahead Web Site, One Step Ahead Catalog, Safe N' Secure, http://www.onestepahead.com/jump.jsp?1Gen=detail&itemID=1068&item Type=Product&ProductID=1068, printed Feb. 27, 2003.

* cited by examiner

TOY RETENTION BLANKET AND SYSTEM

CROSS-REFERENCE TO RELATED APPLICATION

This application claims the benefit of U.S. provisional application No. 60/360,246, filed Feb. 27, 2002, the contents of which is hereby incorporated herein by reference for all purposes.

FIELD OF INVENTION

The invention generally relates to a blanket for infants and children. In particular, the invention relates to a system including a blanket that provides warmth, comfort, and tactile stimulation to children while retaining toys and other articles at the blanket.

BACKGROUND

Modern families are highly mobile and frequently on the go, which is often problematic where there are infants and toddlers that must necessarily be accompanied by an array of baby paraphernalia. The various items parents are typically obligated to carry around often include pacifiers, teethers, rattles, toys, dolls, action figures, and security blankets in addition to the bottles or snacks, diaper bag, and changes of clothes. Quite clearly, running errands and traveling with children presents a tremendous challenge for parents.

To add to the frustration, parents are especially concerned about toys, especially oral devices like pacifiers, that may be dropped, thrown, or lost. Repeatedly seeing these toys ending up on a dirty grocery floor, under a restaurant table, across the airplane aisle, or jammed under a car seat is extremely frustrating and only elevates the parent's anxiety level. There is therefore a need for a device that can secure these toys where the child may have access to them, thereby preventing the toys from being dropped, lost, soiled or otherwise exposed to germs.

SUMMARY OF THE INVENTION

The present invention remedies the problems encountered in the prior art with a system including a small blanket, approximately the size of a persons lap, with a toy and children's article attachment device. The invention provides children ages approximately 3 months to 3 years a blanket made of suitable materials with an apparatus for removably attaching small toys to the blanket and an apparatus for removably attaching the blanket itself to other objects. The invention also makes it simple for parents to detach and reattach new toys as the child becomes ready for something new.

The invention in the preferred embodiment is an interactive, portable article retention system for infants and children, which is comprised of a blanket that consists of a blanket body with at least one layer of fabric, one or more tactile retainers affixed to the front surface; a border conforming to the perimeter of the blanket; and attachment means adapted to detachably attach the retention system to a child seating device or child conveyance device. The child seating device generally includes highchairs, baby bouncer seats, and infant swings; while the child conveyance device generally includes strollers, child carriers, car seats, and shopping carts.

In some embodiments, the tactile retainers are lengths of fabric which, when ends of such lengths are tied together, they are able to detachably attach toys and/or rings and the like.

The lengths of fabric, i.e. fabric strips, are preferably sewn to the front of the baby blanket. When knotted or otherwise tied, the fabric strips are substantially larger than a simple bow made of ribbon, and therefore provide tactile stimulation to the child as well as a makeshift handles to grasp while the blanket is lying on the lap of the child or the child lying on the blanket. In the preferred embodiment, there are four fabric strips that are arrayed in a square across the front surface of the blanket. In general, the blanket does not have attached to the front surface any type of article that would provide discomfort to the child when the child is lying down on the blanket.

In some embodiments, the border is substantial enough to constitute a soft barrier that inhibits toys, and perhaps the child, from rolling outside the confines of the blanket body. The barrier is preferably a ruffle that makes the border thicker than the blanket body, although one skilled in the art will recognize that it may also be a type of padded roll or raised trim.

In some embodiments, the attachment means includes flexible fabric tabs adapted to directly attach to the child conveyance device. Each attachment means preferably includes a fastener such as a button, snap, hook, or VELCRO® type straps capable of detachably attaching the blanket to the lap strap(s) or handle bar of a highchair, stroller, child carrier, car seat, or shopping cart, for example.

In some embodiments, the blanket further includes a zippered or stitched pocket or pouch affixed to, for example, the back surface of the blanket. In still other embodiments, the retention system further includes a bib, burp cloth, or soft baby wipe case, which may or may not be pattern-coordinated with the blanket itself.

In some embodiments, the blanket is adapted to be placed on the lap of handicapped children, adults, and elderly people who are confined to their bed or to a wheel chair. The blanket in some of these embodiments includes one or more retainers and pockets able to retain or carry around various articles including, for example, eye glasses, pens/paper, books, games, and toys. The blanket in these embodiments would generally be larger than that of an infant or child blanket described in other embodiments. The retainers may be tactile retainers, such as ties and links, useful to aid visually impaired users, for example, to locate the articles or pockets on the blanket. The attachment means is preferably adapted to detachably attach the retaining blanket to a wheelchair. The attachment means in some embodiments includes pairs of straps with fasteners that attach to the armrests, seat backing, front bar, and/or back bars in the backrest area of a wheelchair.

BRIEF DESCRIPTION OF THE DRAWINGS

The accompanying drawings illustrate preferred embodiments of the invention in accordance with the practical application of the principals thereof, and in which.

DESCRIPTION OF THE PREFERRED EMBODIMENTS

Figure 1:
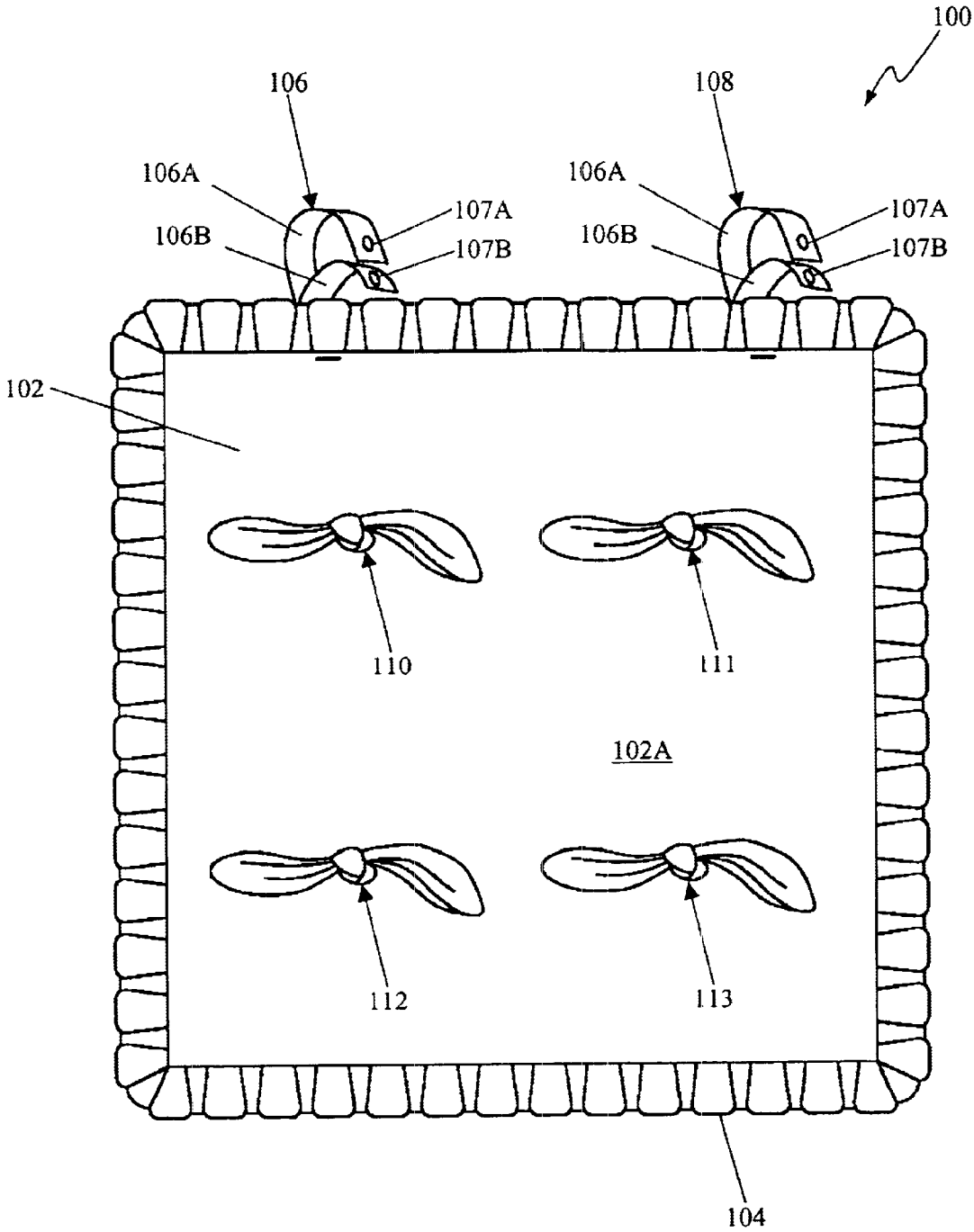
FIG. 1 is a plan view of the front of the preferred embodiment of the portable toy retention system of the present invention.

Throughout the following description, reference will be made to the drawings. Identical reference numerals will be used throughout the several views to indicate the same or like parts of the invention. Dimensions are for illustrative purposes and may be scaled up or down.

Referring to FIGS. 1 through 4, the preferred embodiment of the portable toy retention system is illustrated. The system is comprised of a blanket generally including a blanket body 102 with tactile toy retainers 110–113, a border 104, and an attachment means for detachably affixing the blanket to any of a number of devices for seating or transporting infants or children.

The blanket 102 is preferably comprised of fabric or other material generally sized to accommodate a newborn, infant, or small child. In the preferred embodiment, the blanket in plan view is in the shape of a square, although other geometric shapes including rectangles, circles, ovals, and polygons are within the scope of the invention. The length of sides of the square blanket body 102 of the preferred embodiment is approximately 15 inches although one skilled in the art will appreciate that the dimensions may be modified to tailor the blanket to children of different sizes, or to adapt the blanket to a stroller or shopping cart, for example, to which it might be attached.

The blanket may be comprised of one or more layers of fabric or suitable material providing a front side 102A and a back 102B. The front side 102A is generally exposed to the child and should therefore be pleasant to the touch. The back surface 102B of the blanket is preferably made of a durable, water-resistance, or stain-resistant material. Suitable materials for either the front and back surfaces includes, but is not limited to, cotton, terry cloth, flannel, fleece, silk, satin, velvet, chenille, oil cloth, nylon, rayon, suede or polymeric substance such a polyester, or any blend or combination thereof.

In between the front surface 102A and back surface 102B is an optional one or more middle layers of piling, batting, or filler known to those skilled in the art. The optional middle layers serve to provide warmth when lying on the lap or body of the child, to enhance the comfort of a child when lying on the blanket 102, and to provide the weightiness to the product which helps make it sturdy enough to support the toy system without crumpling under the weight of the toys and articles attached thereto. Suitable middle layer materials include fluffy layers of cotton, wool, or polyester, for example.

At the outer edges of the blanket 102 is a fabric border 104. In the preferred embodiment, the border 104 is a ruffle that completely circumscribes the blanket 102. To some degree, the ruffle of the border 104 has thickness or body that helps to retain any toys or other children's articles within the confines of the blanket 102. The border 104 may therefore be a soft barrier able to inhibit or prevent toys or the child lying thereon from rolling outside the protective confines of the toy retention device. With a proper batting, for example, the border 104 may be considerably thicker and elevated above the blanket 102. With the border 104, the overall dimensions of the retaining blanket is preferably 17 or 18 inches on either side.

In other embodiments, the border 104 is substantially flat and not ruffled. Such a border may be formed using a mitered frame in the shape of a square or rectangle, for example.

Affixed to the blanket 102 are a plurality of tactile toy or article retainers, hereafter referred to as tactile retainers. In the preferred embodiment, there are four tactile retainers 110–113 that are non-removably attached to the front surface 102A where they are accessible to an infant in a seated or inclined position when the blanket 102 is placed on his or her lap. The tri-purpose tactile retainers 110–113 are used to detachably attach toys and other articles, to provide tactile sensory stimulation to the child, and to provide some dimensionality sufficient for the child to grab, hold, or otherwise manipulate the retainer.

Figure 5:
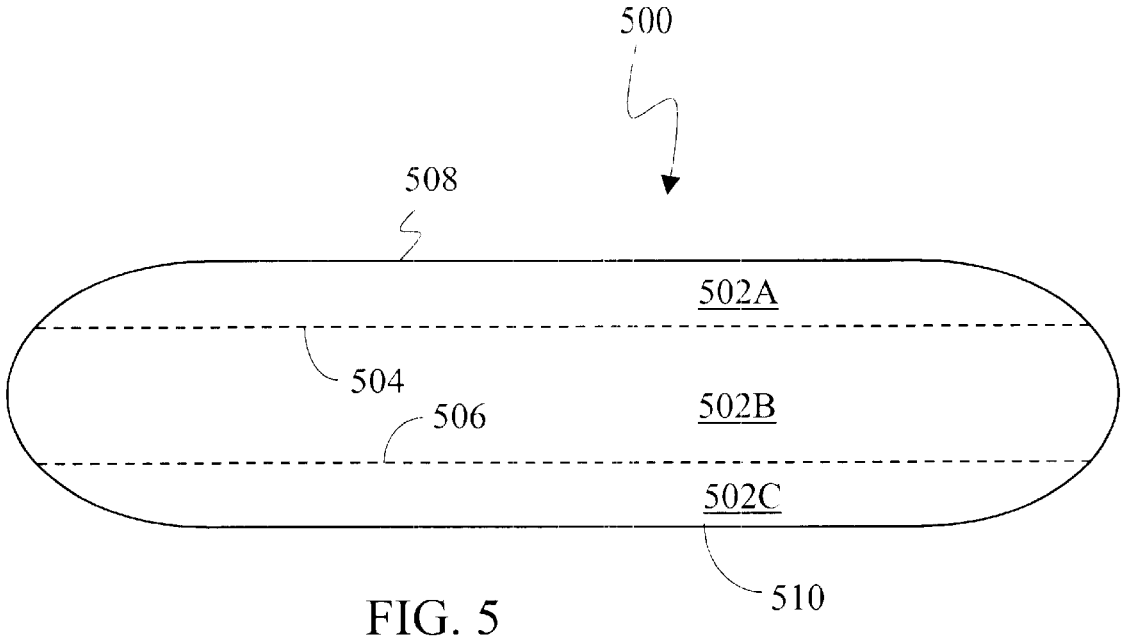
FIG. 5 is a plan view of the preferred embodiment of an unfolded fabric strip used to construct a tactile retainer.
Figure 6:
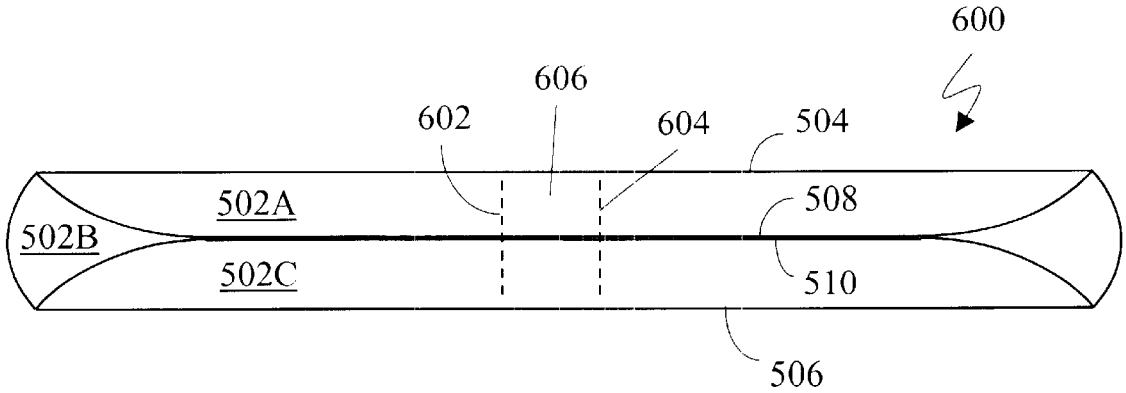
FIG. 6 is a plan view of the preferred embodiment of a folded fabric strip used to construct a tactile retainer.

In the preferred embodiment, the tactile retainers 110–113 are cloth strips or lengths that are attached to the blanket 102. A cloth strip 500, illustrated in plan view in FIG. 5, is preferably one or two layers of fabric in a substantially elongated shape. In the preferred embodiment, the side 502A and 502C are folded towards the inner region 502B about fold lines 504 and 506, respectively. As illustrated FIG. 6, the cloth strip 600, after being folded inwardly, has the outer edges of the strip 500 abutting one another at the center of the folded strip 600. The thickness of the center portion of the folded cloth strip 600 is generally twice as thick as the left and right extremes of the cloth strip 600, thereby enhancing the overall thickness of the knotted tactile retainers 110–113. One skilled in the art will recognize that a similar affect may be achieved by using a multiplicity of layers of cloth with and without various types of folds. These folded strips 600 are preferably 11 inches long and between approximately one and two inches wide.

Figure 2:
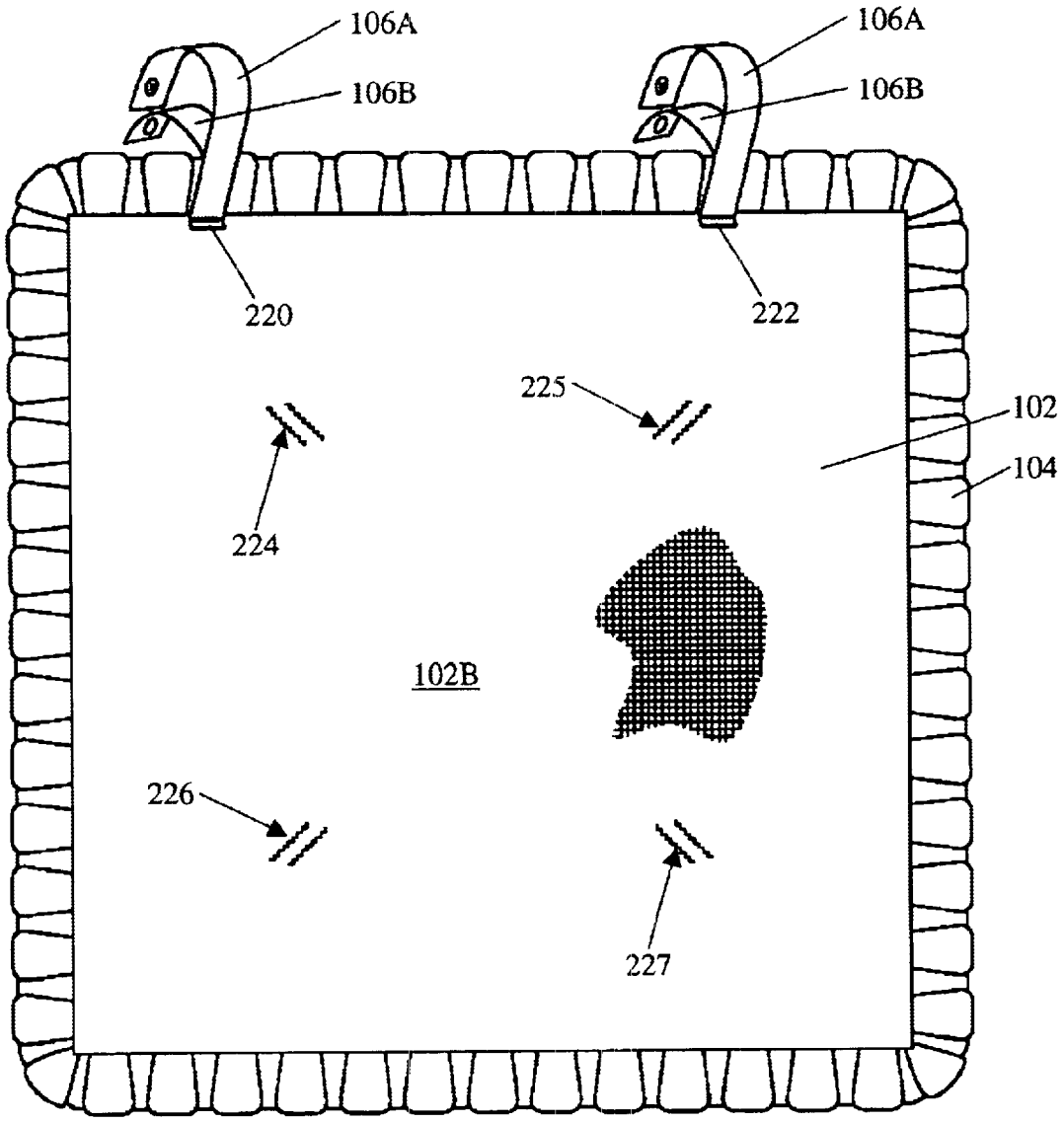
FIG. 2 is a plan view of the back of the preferred embodiment of the portable toy retention system of the present invention.

Each of the one or more folded cloth strips 600 is preferably permanently attached to the blanket 102 using a plurality of stitches. In some embodiments, the stitches form two parallel lines of stitches 602 and 604 trending substantially perpendicular to the length of the cloth strip 600. It is preferable to space the stitch lines 602 and 604 sufficiently far apart, approximately 0.75 inches, to permit a channel in proximity to the region 606, between the strip 600 and blanket 102, to receive a coupling device with which toys and other articles may be attached to the retention blanket 100. The stitch lines 224–227 preferably engage the thickness of the blanket 102, as illustrated in FIG. 2.

Figure 7:
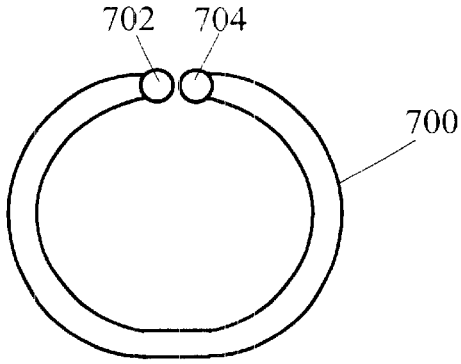
FIG. 7 is an embodiment of toy and/or article coupling device used in combination with the tactile retainer of the preferred embodiment.

The coupling device in FIG. 7 of the preferred embodiment is a flexible ring 700 in which the endpoints are biased towards one another. The ring 700 may therefore be expanded for purposes of engaging the cloth strip 700 or receiving toys, teethers, pacifiers, and other articles. One skilled in the art will recognize that there are a number of alternative suitable coupling devices including open and closed rings and carabiners, for example, made of plastic, non-toxic rubber, polymeric material, or wood. The rings may take various shapes and forms, and may be open or completely closed. Several rings may even be linked together to provide a longer extension of the toy or child article. Other attachable articles that may be included in the retention system or sold separately are, for example, matching fabric dolls, animals, and other figures, optionally patterned after the blanket 100.

The folded cloth strips 600, after being sewn to the blanket's front side 102A, are preferably tied in knots, thereby forming a simple and cost effective form of the tactile retainer. With a knot, the tactile retainers 110–113 may be used to detachably attach toys, children's articles, and/or rings 700. Using the tactile retainers, with or without the rings 700, a parent may attach and reattach toys and articles which might otherwise be dropped, pushed, thrown, or fall away from the retaining blanket where it might be lost or soiled. The knots 300, in addition to the three-dimensionality and texture resulting from the creases 332 in the fabric, provide tactile stimulation.

Figure 3:
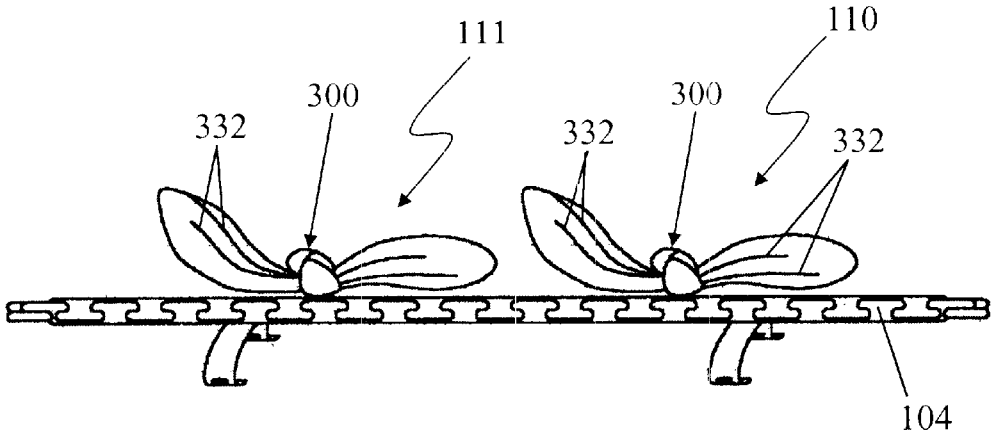
FIG. 3 is a top side view of the preferred embodiment of the portable toy retention system of the present invention.
Figure 4:
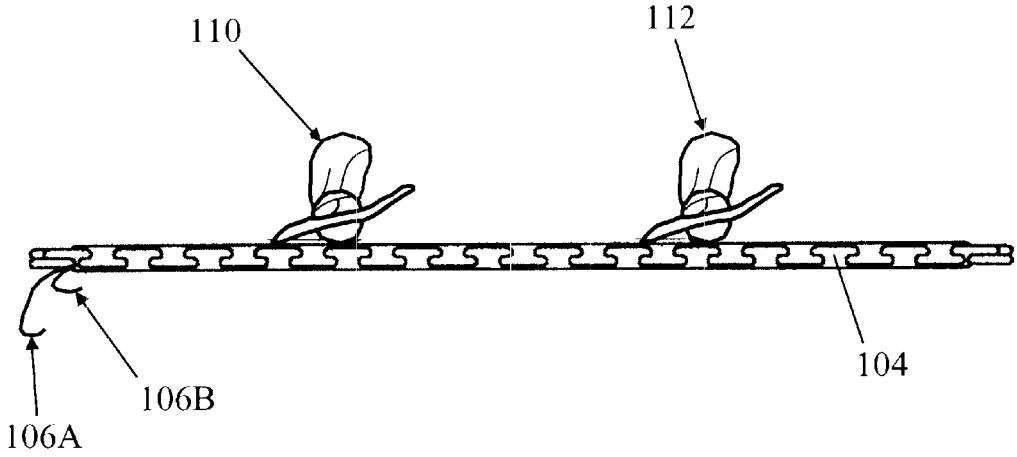
FIG. 4 is a left side view of the preferred embodiment of the portable toy retention system of the present invention.

In addition, the tactile retainers are sufficiently large or "voluminous" that they may be easily held and manipulated by the small hands of an infant or child attempting to hold the retention blanket 100. The substantial size of the tactile retainers is illustrated in FIGS. 3 and 4 where it can be seen that the height and width of the knots is comparable to the thickness of the blanket body 102 or border 104. The tactile retainers are in fact superior to the delicate ribbons and strings illustrated in the prior art, which are too thin and lie too flat to permit an infant to effectively grasp and manipulate. The tactile retainers of the preferred embodiment may therefore enhance a child's ability to push/pull at the retaining blanket 100 while the blanket is lying on the child, or to move around with the retaining blanket 100.

In some embodiments, the blanket 100 further includes a pocket or pouch, such as a zippered pocket or stitched pouch, affixed to the back surface of the blanket.

The retention blanket 100 further includes an attachment means for detachably attaching the blanket to any of a number of devices for seating or transporting infants and children. In the preferred embodiment, the attachment means is comprised of two pairs of fabric tabs adapted to engage any number of articles including the handle of stroller or baby carrier, the belt of a car seat, or the handrail of a shopping cart, for example. Each pair of tabs 106, 108 includes a first tab 106A and second tab 106B with complimentary fasteners 107A and 107B, respectively. In the preferred embodiment the first tab 106A and second tab 106B are formed from a common strip of double layer cloth that is sewn to the back of the blanket 102B using at lease one line of stitches. The fasteners 107A and 107B in this embodiment are approximately seven inches apart, and may include snaps, buttons, or hooks and loops such as VELCRO, for example.

Some embodiments of the invention further include a pouch or tote bag that can be used to store the retention blanket itself or a bib, burp cloth, diaper and/or baby wipes. Such a bag provides a handy storage area for parents because it provides a self-contained unit with everything necessary for quick trips away from the house. The bag preferably includes a color or pattern that matches or otherwise coordinates with the blanket 100. Matching bibs, burp cloths and soft baby wipe cases may also be sold separately or in conjunction with the blanket and bag. The preferred embodiment of the soft baby wipe case may include zippers, reusable tape or VELCRO for ease of refilling and for appropriate closure to ensure sanitation and freshness.

The tote bag preferably has a handle including a snap, button, or VELCRO, for example, permitting the tote bag to be attached and detached from the child conveyance device, separate and apart from the attachment means for the blanket 102. The tote bag may further include one or more inside and/or outside pockets useful to hold anything from a baby bottle to a cell phone, for example.

In general, the preferred materials from which the retention blanket or bag are constructed or sewn may be printed or pattered with colorful and aesthetically pleasing patterns that match each other or one or more toys, bibs, burp cloths, and baby wipe cases.

Figure 8:
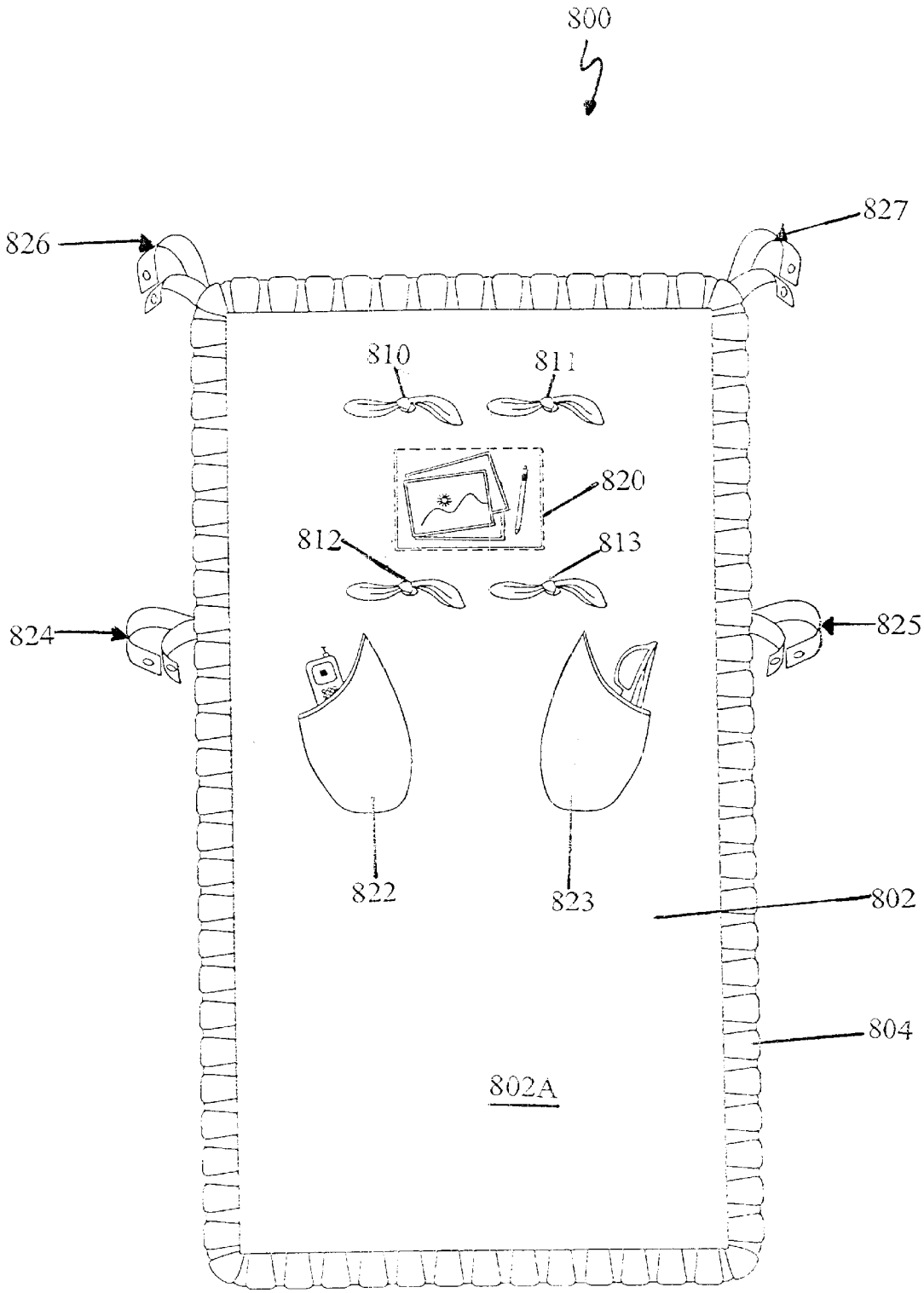
FIG. 8 is a plan view of the front of a portable article retention system adapted for a wheelchair, according to the first preferred embodiment of the present invention.
Figure 9:
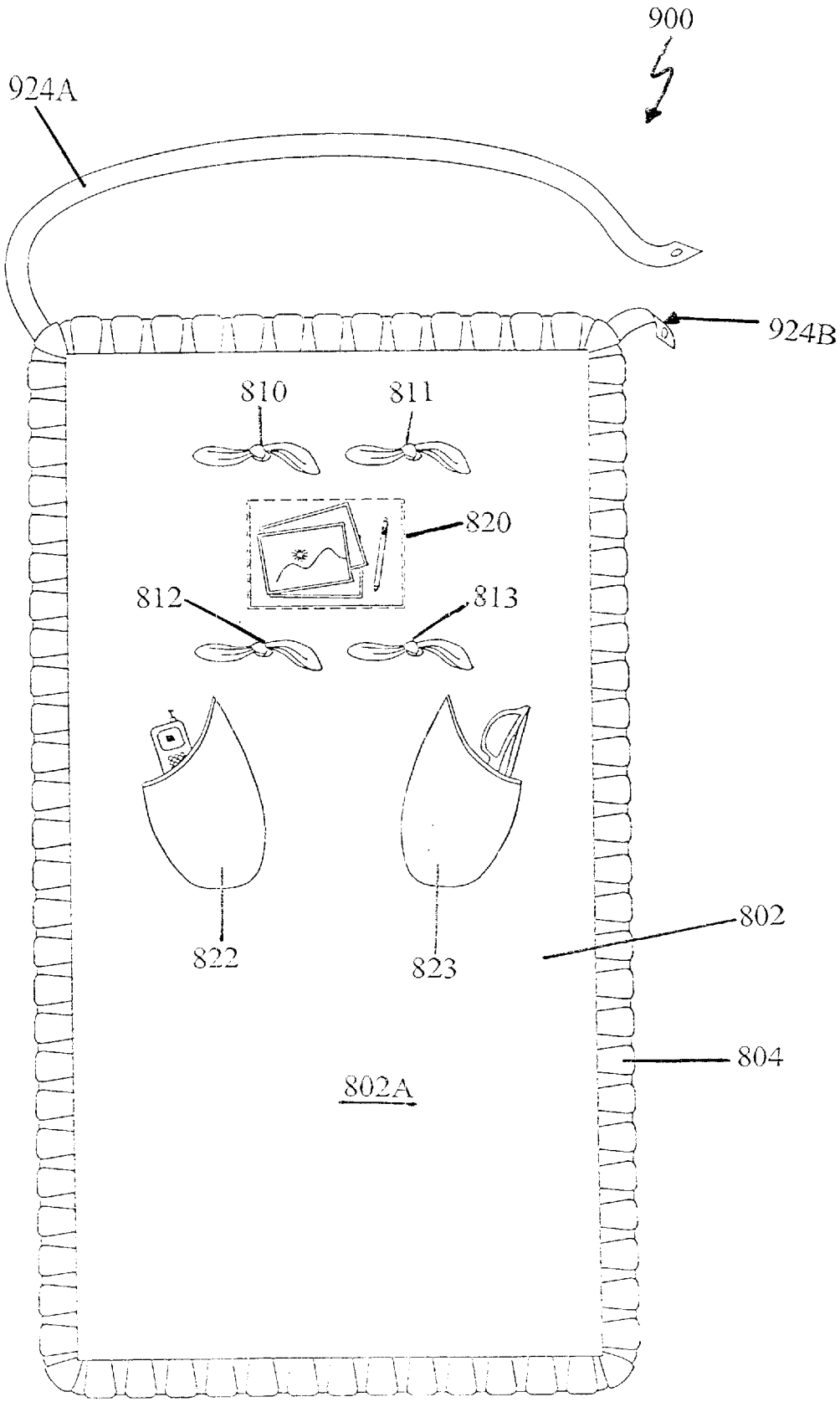
FIG. 9 is a plan view of the front of a portable article retention system adapted for a wheelchair, according to the second preferred embodiment of the present invention.

In some embodiments, the retention blanket is adapted to a wheelchair where it may be used on the lap of a handicap or elderly person. Referring to FIGS. 8 and 9, plan views of the front of the first and second embodiments of the portable article retention system adapted for a wheelchair are illustrated. Both the retention blanket 800 and retention blanket 900 include a border 804 and a blanket body 802, having a front surface 802A and a back surface (not shown). For purposes of adapting the blankets 800 and 900 to a wheelchair, the width of the blankets are substantially equal to the width of a wheelchair, and the length suitable to span the user's lower body including the legs and feet.

The blanket body 802 generally comprises the same materials and construction techniques as the blanket body 102 described above, while the border 804 generally comprises the same materials and construction techniques as the border 104 described above.

Accessible from the front surface 802A are one or more retaining devices including, for example, the tactile retainers 810–813, pouch 820, and pockets 822–823, which are incorporated into the blanket body at strategic locations to hold the variety of articles of importance to the user. In addition to secure different articles, the tactile retainers 810–813 in the form of knotted fabric strips help to provide means for the handicap and elderly, especially persons with arthritis or other debilitating diseases, to grab onto and manipulate the blanket 800 or the articles retained thereon. The tactile retainers 810–813 may further include one or more rings such as a flexible ring 700.

In the preferred embodiment, the pouch 820 is constructed of a transparent plastic or vinyl to make the contents of the pouch readily visible to the user and/or others. The pouch 820 may also be sized to accommodate papers and keepsakes including but not limited to special notes, pens and pencils, and pictures of friends and family. The pockets 822 and 823 are preferably constructed of the same material or compatible patterned material as the blanket front surface 802A.

In general, at least one and preferably all of the one or more retaining devices are confined to the upper half of the blanket body 802 where they are accessible to the user of the blanket when the blanket is attached to a wheelchair and sprawled over the legs of the user. The retaining devices, specifically the pouches and pockets, may further include a zippered and/or VELCRO enclosure, and be sized to receive and retain various articles including children's electronic games, toys, small books, colors, paper, walkman or portable CD, TV and DVD players to adult's pens/paper, stationery, playing cards, reading glasses, TV remote, walkman, portable CD, TV or DVD players, and/or cell phone, for example.

Each of the wheelchair blankets includes an attachment means adapted to detachably attach the blanket to a wheelchair. In the first embodiment of the wheelchair blanket 800, the attachment means comprises a plurality of pairs of tabs, preferably four fabric tabs 824–827, adapted to affix to the armrests of a wheelchair. For versatility and convenience, the straps include fasteners such as snaps, buttons, and hook and loops sold under the trademark of VELCRO® that permit the capture of the horizontal portion of the armrests or the vertical supports thereof. In the preferred embodiment, the upper set of fabric tabs 826–827 are purposefully placed near the upper end of the blanket 800 so as to inhibit the blanket from migrating off the lap of the user. The fabric tabs 824–825 are preferably sized and positioned to provide side-to-side stability of the blanket 800.

In addition to the armrest, the attachment means may also be adapted to engage the front bar or back bars in the backrest area of conventional wheelchairs.

In the second embodiment of the wheelchair blanket 900, the attachment means comprises a belt including a first strap 924A and second strap 924B adapted to detachably attach around the waist of the user and/or the wheelchair seat backing. As such, the length of the belt must be longer than the circumference of the user's waist. The first strap 924A and second strap 924B of the preferred embodiment include snap fasteners, although one skilled in the art will recognize that a combination of hook and loop VELCRO fasteners or buckle would afford the user the option to adjust the length and tightness of the waist belt. As in the first embodiment of the wheelchair blanket 800, the width of the blanket 900 is specifically adapted to the width of a wheelchair, and the length made to accommodate a person's lower body.

The wheelchair blankets have application to both the handicap and the elderly, which may be confined to the wheelchair for much of the day or extended periods of time. One skilled in the art will recognize that wheelchairs come in sizes for children, young adults (e.g. teenager), adults, and extra-large adults. As such, the different embodiments of the wheelchair blankets may be specifically adapted to each of the specific variations as necessary without departing from the scope of the invention. The term wheelchair as used herein includes manual wheelchairs, electric wheelchairs, and electric scooters.

Although the description above contains many specifications, these should not be construed as limiting the scope of the invention but as merely providing illustrations of some of the presently preferred embodiments of this invention.

Therefore, the invention has been disclosed by way of example and not limitation, and reference should be made to the following claims to determine the scope of the present invention.

We claim:

1. A portable article retention system for infants and children, comprising:

(a) a blanket having a front surface and a back surface, the blanket consisting of:

(i) a blanket body comprising at least one layer of fabric;

(ii) one or more tactile retainers, affixed to the front surface, for detachably attaching toy articles by tying and stimulating a child's tactile senses; wherein each of the one or more tactile retainers includes a knot adapted to be held in the hand of the child when tied;

(b) a border conforming to the perimeter of the blanket; and (c) attachment means adapted to detachably attach the retention system to a child conveyance device;

wherein the child may grasp the blanket body by means of the one or more tactile retainers independent of whether the tactile retainers are used to retain toy articles.

2. The retention system of claim 1, wherein the one or more tactile retainers are multi-layer fabric strips directly attached to the front surface of the blanket.

3. The retention system of claim 2, wherein the one or more multi-layer fabric strips are permanently attached to the blanket.

4. The retention system of claim 3, wherein each of the one or more multi-layer fabric strips is adapted to be tied in a knot for retaining children's articles and toys.

5. The retention system of claim 4, wherein the knot is of a size susceptible to being grasped by the hand of a child between the ages of three months and three years.

6. The retention system of claim 3, wherein the one or more multi-layer fabric strips is permanently sewn to the blanket body.

7. The retention system of claim 6, wherein the one or more multi-layer fabric strips is sewn to the blanket body with a plurality of stitch lines spaced so as to create a channel between the blanket body and fabric strip to receive a coupling device.

8. The retention system of claim 1, wherein at least one layer of fabric of the blanket body is made of material selected from a group consisting of cotton, fleece, terry cloth, flannel, silk, satin, rayon, chenille, quilting material, polyester, and polymeric material.

9. The retention system of claim 8, wherein at least one layer of fabric of the blanket body is made of a material selected from the group consisting of padding, piling, batting, and filler.

10. The retention system of claim 2, wherein the border is a soft barrier that is thicker than the blanket body, thereby inhibiting a child's article from being displaced from the blanket body while lying on a horizontal surface.

11. The retention system of claim 10, wherein the soft barrier is a ruffle.

12. The retention system of claim 2, wherein the attachment means is comprised of at least one pair of tabs including a fastener.

13. The retention system of claim 12, wherein the fastener is selected from the group consisting of snaps, buttons, and hook and loop type fastener material.

14. The retention system of claim 13, wherein the attachment means is comprised of two pairs of tabs with snap fasteners adapted to detachably attach to the lap strap or handle of a highchair, stroller or baby carrier, the handrail of a shopping cart, and the belt of a car seat.

15. The retention system of claim 2, wherein the system further includes a tote bag adapted to receive the blanket.

16. The retention system of claim 15, wherein the system further comprises a pattern-coordinated bib, a pattern-coordinated burp cloth, and a pattern-coordinated soft baby wipe case.

17. The retention system of claim 16, wherein the soft baby wipe case is made of a combination of materials selected from the group consisting of oil cloth, cotton, vinyl, plastic, and polyester.

18. A portable article retention system for infants and children, comprising:

(a) a blanket having a front surface and a back surface, the blanket consisting of:

(i) a blanket body comprising at least one layer of fabric;

(ii) a plurality of multi-layer fabric strips directly affixed to said front surface, wherein each of the fabric strips is tied in a knot for retaining children's articles, wherein each of the one or more knots is adapted to be held in the hand of a child; (b) a soft barrier conforming to the perimeter of the blanket; and (c) a plurality of tabs including a fastener adapted to detachably attach the retention system to a child conveyance device.

19. The retention system of claim 18, wherein the soft barrier is a ruffle.

20. The retention system of claim 18, wherein the soft barrier is a padded roll or raised trim.

21. The retention system of claim 18, wherein the fastener includes complimentary snaps.

22. The retention system of claim 21, wherein the plurality of fabric strips are sewn to the blanket body with a plurality of stitch lines spaced so as to create a channel between the blanket body and fabric strip to receive a coupling device.

23. A portable article retention system for infants and children, comprising:

(a) a blanket having a front surface and a back surface, the blanket consisting of:

(i) a blanket body comprising at least one layer of fabric;

(ii) a plurality of multi-layer fabric strips directly affixed to said front surface, wherein each of the fabric strips is tied in a knot for retaining children's articles, wherein each of the one or more knots is adapted to be held in the hand of a child;

(iii) pouch affixed to said back surface;

(b) a soft barrier conforming to the perimeter of the blanket; and (c) a plurality of tabs including a fastener adapted to detachably attach the retention system to a child conveyance device.

24. A portable article retention system adapted for use with a wheelchair for handicap or elderly persons, comprising;

(a) a blanket having a front surface and a back system characterized by a width and length, the blanket consisting of:

(i) a blanket body comprising at least one layer of fabric;

(ii) one or more tactile retainers affixed to the front surface;

(iii) one or more pockets accessible from the front surface;

(iv) one or more pouches accessible from the front surface;

(b) a border conforming to the perimeter of the blanket; and (c) attachment means adapted to detachably attach the retention system to a wheelchair.

25. The portable article retention system of claim 24, wherein the width is substantially equal to the distance between the armrests of the wheelchair.

26. The portable article retention system of claim 25, wherein the attachment means includes a plurality of pairs of straps with fasteners adapted to detachably attach to the vertical supports of the armrests of the wheelchair.

27. The portable article retention system of claim 25, wherein the attachment means includes a belt comprising a first strap and a second strap adapted to detachably attach to each other around the waist of the user and a seat backing of the wheelchair.

* * * * *